United States Patent [19]

Jacquin et al.

[11] 4,285,804

[45] Aug. 25, 1981

[54] PROCESS FOR HYDROTREATING HEAVY HYDROCARBONS IN LIQUID PHASE IN THE PRESENCE OF A DISPERSED CATALYST

[75] Inventors: Yves Jacquin, Sevres; Michel Davidson, Levesinet; Jean-Francois Le Page, Rueil Malmaison, all of France

[73] Assignee: Institut Francais du Petrole, Rueil-Malmaison, France

[21] Appl. No.: 150,825

[22] Filed: May 19, 1980

[30] Foreign Application Priority Data

May 18, 1979 [FR] France ..... 79 12.933

[51] Int. Cl.[3] ..... C10G 45/06

[52] U.S. Cl. ..... 208/48 R; 208/108; 208/112; 208/143; 208/254 H; 208/264; 208/216 R

[58] Field of Search ..... 208/108–112, 208/48 R, 48 AA, 143, 213, 254 H, 264

[56] References Cited

U.S. PATENT DOCUMENTS

| | | | |
|---|---|---|---|
| 3,240,718 | 3/1966 | Gatsis | 208/264 X |
| 3,249,530 | 5/1966 | Gatsis | 208/264 |
| 3,331,769 | 7/1967 | Gatsis | 208/210 |
| 3,617,503 | 11/1971 | Rogers et al. | 208/97 |
| 3,619,410 | 11/1971 | Gleim | 208/108 |
| 3,622,498 | 11/1971 | Stolfa et al. | 208/108 |
| 3,657,111 | 4/1972 | Gleim | 208/108 |
| 3,694,352 | 9/1972 | Gleim | 208/215 |
| 4,125,455 | 11/1978 | Herbstman | 208/108 |
| 4,134,825 | 1/1979 | Bearden et al. | 208/108 |
| 4,192,735 | 3/1980 | Aldridge et al. | 208/112 |

*Primary Examiner*—Delbert E. Gantz
*Assistant Examiner*—G. E. Schmitkons
*Attorney, Agent, or Firm*—Millen & White

[57] ABSTRACT

A mixture of heavy hydrocarbons, hydrogen and fresh catalyst comprising metals from the groups Vb, VIb, VIIb or VIII is passed first in a furnace for a limited heating time and then in a reactor where recycled catalyst is also added; the recycled catalyst is used in the form of a suspension recovered by fractionation of the reaction product.

13 Claims, 1 Drawing Figure

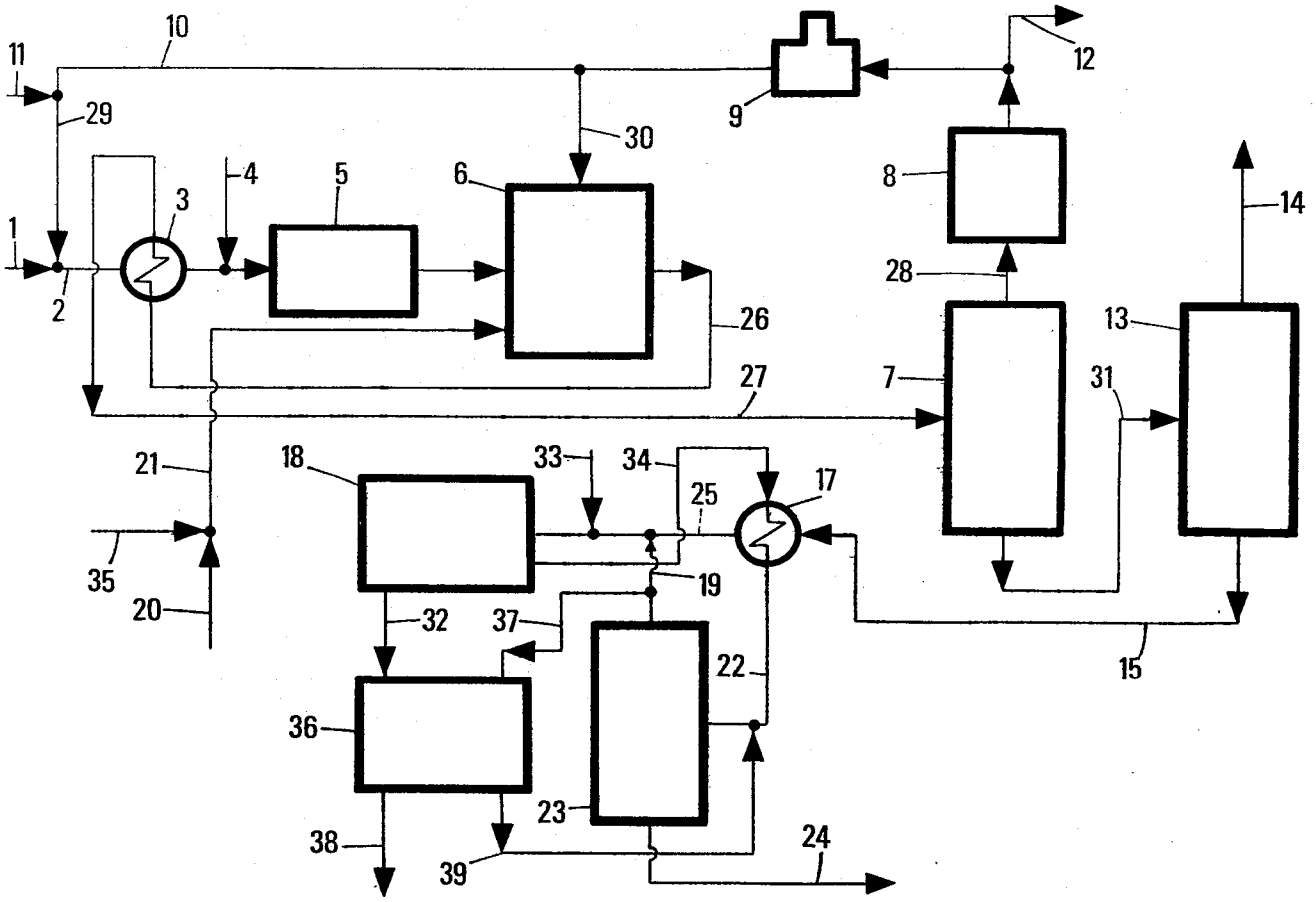
1
2
3
4
5
6
7
8
9
10
11
12
13
14
15
17
18
19
20
21
22
23
24
25
26
27
28
29
30
31
32
33
34
35
36
37
38
39

PROCESS FOR HYDROTREATING HEAVY HYDROCARBONS IN LIQUID PHASE IN THE PRESENCE OF A DISPERSED CATALYST

BACKGROUND OF THE INVENTION

The present invention relates to petroleum refining and more precisely to processes for the hydroconversion of crude oils, heavy hydrocarbon fractions and petroleum bottoms.

The feedstock which is used in the process according to the present invention may be any high-boiling hydrocarbon oil, for example an oil boiling above 350° C. The initial source of the oil may be any hydrocarbon reservoir of ancient origin, including, besides crude oil, such materials as shale oil or oily sands, or liquid hydrocarbons resulting from coal liquefaction.

Petroleum and the oil fractions are very complex mixtures comprising, in addition to hydrocarbons, various compounds, mainly containing sulfur, nitrogen, oxygen and metals. These compounds are present in variable amounts and nature, depending on the origin of the crude oil and the oil fractions. They usually constitute impurities detrimental to the quality of the oil products, for reasons of pollution, corrosion, odor and stability. Among the many methods proposed for their removal, the catalytic treatments in the presence of hydrogen are the most common.

This technique has the advantage to yield products of good quality from crude oils and residues having a high content of impurities.

The difficulties encountered in the treatment of these feedstocks relate mainly to the presence of asphaltenes and metals which, under insufficiently controlled conditions, lead to a deactivation of the catalysts.

The contaminating metallic agents may be present as oxides or sulfides; they are however usually present as organometal compounds, such as porphyrins and their derivatives. The most common metals are vanadium and nickel.

The asphaltenes are present as a colloidal suspension which may agglomerate and settle on the catalyst in the conditions of hydrorefining. Thus the fixed bed hydrotreatment of these charges does not give satisfactory results, the catalyst deactivating as it is fouled with coke and metals.

The ebulliated bed technique, as applied to heavy feed charges (FP No. 2,396,065 and No. 2,396,066), reduces by 1.5 times the catalyst consumption with respect to the prior fixed bed processes and increases by approximately 2.5 times the production of liquid products as compared to the processes operated with preliminary deasphalting of the initial charge. This type of process is satisfactory for converting the soluble organometallic compounds; it is however less efficient as concerns the asphaltenes. Also, when using supported catalysts, some abrasion of the equipment occurs.

Another technique which remedies these insufficiencies, by allowing a better accessibility of the asphaltenes of high molecular weight to the catalytic sites, is disclosed in many patents, such as the French Patent No. 1,373,253 or the U.S. Pat. No. 3,165,463.

This result is attained by using catalytically active metal compounds in extremely divided form. These metal compounds are selected from the groups IV, V, VI or from the iron group, and they are used as a colloidal suspension or as a solution in a solvent. When introduced in the feed charge, they are converted to sulfides and, as the hydrorefining treatment progresses, a slurry forms which contains the catalyst, asphaltenes and various metallic impurities.

This technique implies that the heavy hydrocarbons and the catalyst slurry are separated from the total product discharged from the reaction zone. This operation is performed by any appropriate means, for example by distillation followed with a separation of the catalyst slurry; the latter is recycled to be combined with a fresh hydrocarbon charge. A portion of this slurry has however been previously removed, as catalyst purge, and has been replaced with a substantially equivalent amount of fresh catalytic compound.

This is commonly effected by feeding the pre-heating furnace preceding the reactor with both the fresh hydrocarbon charge, the slurry of recycled catalyst and the fresh catalyst, as described, for example, in the U.S. Pat. Nos. 3,331,769; 3,617,503 and 3,622,498.

Irrespective of the technique adopted, a relatively fast fouling of the pre-heating furnace is observed, as well as a decrease in performance.

The object of the invention is to obviate these drawbacks.

DETAILED DISCUSSION

The present invention concerns a process for hydrotreating hydrocarbon charges of high molecular weight in the presence of a nonsupported catalyst, soluble in the hydrocarbon or very finely suspended in the charge to be treated. This treatment with hydrogen has for object to eliminate sulfur, nitrogen, metals (Ni, V, Na, Fe, Cu) and asphaltenes present in the charge, these eliminations simultaneously resulting in a reduction of the Conradson carbon content of the charges thus treated. The catalyst may be introduced into the unit as a solution in an organic solvent, preferably a hydrocarbon, miscible with the charge, or as an aqueous solution of metals of groups V b, VI b, VII b and/or VIII, preferably molybdenum or (and) tungsten compounds and cobalt or (and) nickel compounds.

According to an essential feature of the invention, the fresh catalyst is injected into the fresh hydrocarbon charge before passage of the latter in the pre-heating furnace, during which it is maintained at about 350°-470° C., and preferably 420°-470° C., for 15 to 180 seconds. On the other hand, the recycled catalyst is injected, as a suspension of small particles in a hydrocarbon oil, after the furnace and, for example, into the duct joining the furnace to the reactor or directly into the reactor, at a temperature usually lower than 350° C., preferably lower than 250° C.

The fresh catalyst is preferably injected as an aqueous or organic solution.

According to a preferred embodiment, the amount of fresh catalyst injected before passage in the furnace is from 20 to 500 ppm, preferably 20 to 100 ppm by weight expressed as the proportion of catalyst metals (metals of the groups IVb, Vb, VIb, VIIb and/or the iron group) with respect to the fresh hydrocarbon charge, while the catalyst from the recycled catalyst fraction, mainly in the form of sulfided particles, is from 1,000 to 20,000 ppm by weight of the same metals relative to the fresh hydrocarbon charge.

According to another preferred embodiment, the recycled catalyst is added as a suspension in a non-negligible amount of a hydrocarbon oil, the weight of oil used to disperse the recycle catalyst being 2 to 100%, preferably 2 to 20%, of the weight of the fresh hydrocarbon charge passing through the furnace. This suspension may be supplied at the inlet of the reactor; it is however preferred to introduce it into the reaction mixture at one or several points of the reaction chamber, to help in removing a part of the reaction heat, in view of its relatively low introduction temperature.

The recycled catalyst is preferably suspended, not in a recycled portion of the hydrotreatment product, but in a separate fraction of the fresh charge whose weight is 2 to 20% of the weight of the fresh charge passing through the furnace.

An ultimate preferred characteristic of the process lies in that the furnace used for heating the charge is a furnace with low residence time (15 to 180 seconds) and can itself be used as a visbreaking furnace operating up to 470° C.

The drawing illustrates an embodiment of the process, given by way of example.

The fresh hydrocarbon charge is fed through the duct (1). It is admixed with hydrogen fed from the duct (29); the resultant mixture (duct 2) is preheated in the exchanger (3) by exchange with the effluent discharged from the reactor. The fresh catalyst is supplied through the duct (4), preferably in the form of an organic and/or aqueous solution and the mixture is supplied to the furnace (5) where it is heated to the preferred temperature of 420° to 470° C. This furnace is preferably of the tubular type. At the exit of the furnace, the mixture is fed to the reactor (6) where the transformation initiated in the furnace is continued. At the outlet of the reactor, the reaction mixture is fed through the duct (26) to the exchanger (3) and then through the duct (27) to the separation unit operated at high pressure (7) where are separated as gas phase and a liquid phase containing the catalyst as a divided suspension. The gas phase is fed through the duct (28) to the unit (8) for elimination of hydrogen sulfide (optionally also ammonium sulfide) by treatment with, for example, a sodium hydroxide or ammonia solution; it is recycled after passage through the compressor (9). Hydrogen is fed through the duct (10), admixed with additional fresh hydrogen (line 11) and injected at the inlet of the unit as pointed out above; a part of the hydrogen gas is however preferably injected through the duct (30) into the reactor (6) at one or more points, this hydrogen injection at a relatively low temperature enabling the control of the reaction temperature.

A purge (12) on the hydrogen line avoids a too large decrease of the hydrogen concentration of the recycle gas attributable to accumulation of light hydrocarbons.

The liquid phase, discharged from the separator (7), may be fed, if necessary, to a low pressure separator not shown. It is then supplied through the duct (31) to the fractionation unit (13) from which are discharged one or more hydrocarbon fractions (for example B.P. $<350°$ C.) (duct 14) and a residue (duct 15); this fractionation unit may be a simple vacuum vaporizer or a vacuum distillation column. At the exit of the fractionation unit, the residue (for example 350° C.+or 500° C.+) is cooled at least to 200° C. in the exchanger (17) and fed through the duct (25) to the unit (18) for separation of the suspended product, i.e. essentially the catalyst, from the liquid phase where it is present as finely divided sulfides. The separation of the suspended solid from the liquid phase may be made easier by injecting, through the duct (19), a light aromatic hydrocarbon distilling at a temperature preferably between 100° and 210° C., which favors the settling of the metals and decreases the viscosity of the liquid phase. A slurry is obtained in the duct (32), which contains sulfides of the catalytic elements and sulfides of metals associated to the feed charge, these sulfides being more or less impregnated with oily, resinous or asphaltenic materials.

This slurry, containing solids, is decanted or centrifuged in the unit (18), and washed in the unit (36) with an aromatic hydrocarbon solvent as defined above, which is fed from the duct (37). After separation, for example by filtration or centrifugation, the recovered catalyst (line 38) is collected, as well as the liquid wash phase (line 39) which can be fed back to the distillation zone (23). A fraction of the solid phase finally collected after separation of the aromatic solvent is admixed (duct 20) with an amount of hydrocarbon oil (duct 35) representing 2 to 100%, preferably 5 to 20%, by weight relative to the fresh hydrocarbon charge fed to the furnace (5); this oil is either a fraction of the product of the process (line 24), after separation of the light aromatic hydrocarbon solvent, or preferably a fraction of the fresh hydrocarbon charges. The resultant mixture is re-introduced into the reactor (6) through the duct (21). The other fraction of the solid phase is discharged from the unit to avoid an accumulation of the sulfides of the metals added as catalysts and the sulfides of the metals (Ni, V, Fe, Na, Cu) initially present in the feed charge. As to the hydrotreated residue, separated from the metals, it is fed through the duct (34) into the exchanger (17) and through the duct (22) into the unit (23) where it is distilled; the light solvent fraction is recycled (line 19) and the residuum, now largely freed from metals, asphaltenes and sulfur initially contained therein, is fed to a storage tank through the duct (24). Additional light aromatic diluent may be supplied through the duct (33).

It can be noted that the use of the exchangers (3) and (17), although preferred, is not necessary to the process. In the same manner, the fresh catalyst, instead of being supplied between the exchanger (3) and the furnace (5), can be supplied before the exchanger (3). A supply just at the inlet of the furnace is however preferred.

Many soluble compounds of metals are known, particularly metals from the groups V b, preferably vanadium, VI b, preferably molybdenum and tungsten, VII b, preferably manganese, and/or VIII, iron group (iron, nickel, cobalt), preferably nickel and cobalt. These compounds may be, as a rule, used here.

By way of example, the following may be mentioned: the $\beta$-ketonic complexes, the penta-and-hexa-carbonyls, the naphthenates, the xanthogenates and the carboxylic acid salts of vanadium, molybdenum, tungsten, manganese, nickel, cobalt and iron, the vanadium, iron, cobalt and nickel phthalocyanines, the heteropolyacids and the thioheteropolyacids of vanadium, molybdenum and tungsten, the vanadium chlorides and oxychlorides and molybdenum blue.

Reference is made, for example, to the soluble catalysts proposed in the French Patent No. 1,373,253 or in the U.S. Pat. Nos. 3,165,463; 3,240,718; 3,249,530; 3,619,410; 3,657,111; 3,694,352 and 4,125,455.

The metals thus introduced, in a soluble form, are rapidly transformed to sulfides by the sulfur of the hydrocarbon charge or the hydrogen sulfide present or formed in the reaction.

The hydrotreatment operation is conducted, as all the operations of this type under a partial hydrogen pressure usually in the range from 50 to 200 bars and preferably from 90 to 150 bars. The temperature within the reaction chamber is advantageously selected from 350° to 470° C. and preferably from 380° to 430° C. The residence time of the liquid charge within the reactor is advantageously selected from 0.1 to 4 hours and preferably from 0.5 to 2 hours.

EXAMPLES

In the following, only the examples 3, 4, 6, 7 and 8 illustrate the process of the invention. The other examples are given for comparison. The catalyst concentrations are expressed in proportion to the weight of the fresh charge.

Experimental procedure

The tests are effected in a pilot plant, under continuous operation. The charge containing the catalyst is heated in a furnace 5 up to the reaction temperature (or even a higher temperature when operating according to the invention) after admixing with the hydrogen gas which, in all cases, is composed of 99% hydrogen and 1% hydrogen sulfide by volume. The effluent is fed to a reaction chamber 6 of about 15 liters capacity, filled with a bed of rings made of refractory material having neither porosity nor internal surface. The external diameter of the rings is 0.6 cm, the internal diameter 0.4 cm and the height 0.6 cm. At the reactor outlet, the mixture is cooled before being passed successively through a high pressure separator and a low pressure separator.

The experimentation has been effected on two types of charges, an Aramco vacuum residue and a Kuwait atmospheric residue whose characteristics are given in Table I.

TABLE I

| Characteristics of the treated charges | VACUUM RESIDUUM ARAMCO* | ATMOSPHERIC RESIDUUM KUWAIT** |
|---|---|---|
| $D_4^{20}$ | 0.996 | 0.969 |
| Viscosity at 98.9° C. cst | 295 | 50 |
| S % b.w. | 4 | 4.06 |
| Ni + V (ppm) | 76.5 | 65 |
| Asphaltenes (%) ($nC_7$) | 3.9 | 2.7 |
| Conradson carbon | 16.2 | 9.5 |

*550° C.+
**350° C.+

EXAMPLE 1

This example is given by way of comparison and illustrates an operation effected without recycling.

There is used an Aramco vacuum residuum to which is added, for this first experiment, 2,000 ppm by weight of molybdenum and 600 ppm by weight of cobalt as naphthenates. The whole charge is passed through the heating furnace at a rate of 7 liters per hour and it is heated to 410° C., at which temperature it is fed to the reaction chamber. The operation is performed at 150 bars and with a $H_2$/HC ratio of 1,000 liters per liter, hydrogen being considered at normal temperature and pressure. The hydrogen gas introduced into the unit contains 1% of hydrogen sulfide. After 8 hours of supply, the unit is considered as operative and the performances given in Table II are obtained.

EXAMPLE 2

A second comparative example is again effected with the Aramco vacuum residuum; 70 ppm b.w. of molybdenum and 20 ppm b.w. of cobalt as naphthenates, and also 2500 ppm of metals as sulfides are added before passage in the furnace. The sulfides have been obtained as disclosed hereinafter. The vacuum residuum 550° C.+ (duct 15) is admixed with the same volume of an aromatic 140°-180° C. hydrocarbon cut. A catalyst cake is obtained by filtration on a rotative filter. The separated catalyst is washed on the filter with the aromatic cut before recovery and re-admixing with the charge. After homogenization in the charge drum, the molybdenum content was 1990 ppm b.w. and the cobalt content 600 ppm b.w. The resultant mixture was then fed to the heating furnace to be brought to a temperature of 410° C. at the furnace outlet. The results are given in Table II. After 40 hours of run, progressive clogging of the duct at the outlet of the furnace is observed.

EXAMPLE 3

In the third experiment, the same Aramco vacuum residuum is treated, but the feed charge and the catalyst are supplied as two fractions, in accordance with the procedure of the invention.

The first fraction, which supplies fresh catalyst at a rate of 70 ppm b.w. of molybdenum and 20 ppm b.w. of cobalt, as naphthenates, is passed through the furnace 5 at a feed rate of 6.3 liters per hour; the temperature at the furnace outlet was 432° C. The second fraction of the charge, amounting to 0.7 liter per hour, was fed directly to the inlet of the reactor 6; this second fraction supplies 1930 ppm of molybdenum and 570 ppm of cobalt, recovered after decantation and washing with the same aromatic cut as in example 2, after about 3 successive recyclings, and admixed with this fraction of the charge; this second fraction was pre-heated to 180° C. The temperature of the mixture of the two streams of charge, at the inlet of the reactor, was 407° C. The results obtained are given in Table II; the performances are better than those observed in the examples 1 and 2; further, in the course of more than 180 hours, no variation of the pressure drop has been observed between the inlet of the furnace and the high pressure separator.

EXAMPLE 4

The same Aramco vacuum residuum is treated in the same conditions as in example 3; thus the charge and the catalyst are introduced in two fractions. However the recovered catalyst is obtained by mere decantation of the catalyst slurry after vacuum distillation of the products from preceding operations, but no treatment with the 140°-180° C. aromatic cut is effected. This slurry is thus admixed with the second fraction of the fresh charge and is supplied directly to the reaction chamber. The results are given in Table II. It is found that the omission of the washing step with an aromatic cut, which allows the dissolution of the products of high molecular weight and high carbon content carried by the catalyst micelles, results in a decrease of the performances, as compared with example 3 including this washing step.

No change of the pressure drop has been observed.

EXAMPLE 5

A Kuwait atmospheric residuum, as defined in Table I, is now used. While operating as in example 1, 2100 ppm of molybdenum and 700 ppm of nickel as naphthenates are admixed with the whole charge at a rate of 7 liters/hour and supplied at the inlet of the furnace. In this furnace, the mixture of the charge with the catalyst is heated to 410° C. and then supplied at the same tem— perature to the reaction chamber. The pressure is 150 bars and the ratio of the hydrogen gas to the liquid hydrocarbons amounts to 1500 liters per liter, the volumes being determined at the normal conditions of temperature and pressure. Hydrogen contains 1% of hydrogen sulfide. After a 8 hour supply, the unit is in steady running condition and the results are those given in the Table II, ex. 5.

EXAMPLE 6

The Kuwait atmospheric residuum is used once more. 70 ppm of molybdenum and 20 ppm of nickel as the naphthenates are admixed with the charge fed to the furnace. The feed rate of the fresh charge is 6.3 liters per hour at the furnace inlet. The temperature at the furnace outlet is 432° C. The second fraction of the charge (0.7 liter/h) is supplied directly to the reactor without passing through the furnace. This second fraction provides 2000 ppm of molybdenum and 670 ppm of nickel which are collected after decantation of the recovered catalyst and washing with an aromatic cut as shown in example No. 2. This catalyst is extracted from the effluent of the comparison example No. 5 and previously admixed with the second stream of fresh charge. Before being supplied to the reactor, this fraction is preheated to 180° C. The temperature of the mixture of the two streams of charge is 407° C. at the inlet of the reactor. The results are summarized in Table II. The yield to 350° C. is higher than in the comparison example No. 5, and the performances are similar, although the consumption of fresh catalyst has been far lower.

EXAMPLE 7

The operation is conducted as in example 6; however the whole fresh charge and the fresh catalyst are supplied at the inlet of the furnace and 0.7 liter/hour of the total reactor effluent is admixed with the catalyst separated as described in example 2. This stream supplies 2000 ppm of molybdenum and 660 ppm of nickel; it is directly introduced into the reactor after heating to 150° C. The results are reported in the Table II. They are similar to those obtained in example 6, although slightly inferior.

EXAMPLE 8

The operation is conducted as in example 6, but the amount of the fresh catalyst (Mo and Ni) supplied at the inlet of the furnace is increased to attain 200 ppm of Mo and 53 ppm of Ni. The results are given in Table II. They are substantially similar to those of example 6, although slightly better.

In the examples 6 to 8, no variation of the pressure drop has been observed over 180 hours.

TABLE II

OPERATING CONDITIONS:
feed rate = 7 liters/hour; $H_2HC$ = 1000 1/1; P = 150 bars.
Residence time in the furnace: 20 seconds; residence time in the reactor: 2 hours.

| | | ARAMCO VACUUM RESIDUUM | | | | KUWAIT ATMOSPHERIC RESIDUUM | | | |
|---|---|---|---|---|---|---|---|---|---|
| | | Ex. 1 | 2 | 3* | 4* | 5 | 6* | 7* | 8* |
| T °C. Furnace outlet | | 410 | 410 | 432 | 432 | 410 | 432 | 413 | 432 |
| Reactor | | 410 | 410 | 407 | 407 | 410 | 407 | 409 | 407 |
| Fresh catalyst (ppm) | Mo | 2000 | 70 | 70 | 70 | 2100 | 70 | 70 | 200 |
| | Co (Ni) | 600 | 20 | 20 | 20 | 700** | 20** | 20** | 53** |
| Recycled catalyst (ppm) | Mo | 0 | 1920 | 1930 | 1910 | 0 | 2000 | 2000 | 2000 |
| | Co | 0 | 580 | 570 | 570 | 0 | 670** | 660** | 670** |
| Hydrodesulfurization % | | 47 | 45 | 51 | 46 | 62 | 63 | 59 | 65 |
| Hydrometallization % | (Ni + V) | 71 | 69 | 77 | 69 | 91 | 95 | 93 | 95 |
| Deasphalting % | | 73 | 68 | 81 | 70 | 89 | 90 | 89 | 91 |
| a. Yield of 350− °C. | | | | | | 30 | 36 | 32 | 36 |
| b. Yield of 550− °C. | | 36 | 29 | 47 | 35 | | | | |

The concentrations are in ppm by weight with respect to the whole fresh charge.
*2 separated injections (catalyst).
**Nickel instead of cobalt. a - for the Kuwait atmospheric residuum.b - for the Aramco vacuum residuum.

What is claimed is:

1. A process for hydrotreating an asphaltene-containing hydrocarbon oil charge stock, comprising the steps of:

(a) admixing said hydrocarbon oil charge stock with hydrogen and fresh catalyst, said catalyst comprising at least one metal compound whose metal component is selected from groups Vb, VIb, VIIb and the iron group of group VIII, the amount of said metal compound, expressed as metal, relative to said hydrocarbon oil charge stock being from 20 to 500 ppm by weight;

(b) passing the resultant mixture from step (a) through a heating zone comprising a heated surface, said mixture being maintained in said heating zone at a temperature of from 350° to 470° C. for from 15 to 180 seconds;

(c) introducing the heated mixture from step (b) into a hydrotreating reaction zone, introducing a recycle catalyst suspension as hereinafter defined into said reaction zone, and maintaining the resultant hydrotreatment reaction mixture in said reaction zone at a temperature of from 350° to 470° C. and a pressure of from 50 to 200 bars for from 0.1 to 4 hours, the introduction of said recycle catalyst suspension providing said hydrotreatment reaction mixture with from 1,000 to 20,000 ppm by weight of said metal catalyst component, expressed as metal, relative to the weight of said hydrocarbon oil charge stock used in step (a);

(d) fractionating the hydrotreated reaction mixture from step (c) into at least one gas phase and at least one phase comprising a slurry of said catalyst in hydrotreated hydrocarbon oil;

(e) fractionating said slurry from step (d), and separately recovering a hydrotreated hydrocarbon oil product fraction and a catalyst fraction, at least a portion of the recovered catalyst fraction being suspended in a hydrocarbon oil recycle carrier and the suspension being supplied at a temperature lower than 350° C. to step (c) as said recycle catalyst suspension.

2. A process according to claim 1, wherein in step (e), said portion of the recovered catalyst fraction is washed with an aromatic hydrocarbon solvent, the washed catalyst is separated from the wash phase, and the separated catalyst is suspended in said hydrocarbon oil recycle carrier.

3. A process according to claim 1, wherein the heating zone of step (b) is a tube heating zone.

4. A process according to claim 1, wherein the metal compound of step (a) is a hydrocarbon soluble compound used as a solution in a hydrocarbon solvent.

5. A process according to claim 1, wherein the amount of metal compound of step (a), expressed as metal is from 20 to 100 ppm by weight.

6. A process according to claim 1, wherein the hydrocarbon oil recycle carrier in step (e) is a separate portion of the hydrocarbon charge stock whose weight is from 2 to 20% of the weight of the hydrocarbon charge passing through the heating zone of step (b).

7. A process according to claim 1, wherein the hydrocarbon oil recycle carrier of step (e) is a portion of the hydrotreated hydrocarbon oil product fraction.

8. A process according to claim 1, wherein the residence time of the hydrotreatment reaction mixture in the reaction zone of step (c) is from 0.5 to 2 hours.

9. A process according to claim 1, wherein the recycle catalyst suspension fed to step (c) is at a temperature lower than 250° C.

10. A process according to claim 1, wherein the temperature, in the heating zone of step (b) is from 420° to 470° C.

11. A process according to claim 1, wherein the hydrotreating reaction zone in step (c) is operated at a temperature of 380° to 430° C. and a pressure of 90 to 150 bars.

12. A process according to claim 1, wherein said fractionating of step (e) is effected at a temperature of at most 200° C., by admixing the catalyst slurry from step (d) with an aromatic hydrocarbon solvent, separating a catalyst fraction from a liquid phase containing oil and said aromatic hydrocarbon solvent, and fractionating said liquid phase by distillation to separately recover said aromatic hydrocarbon solvent and said hydrotreated hydrocarbon oil product fraction.

13. A process according to claim 1, wherein in step (a) the fresh catalyst is in the form of a solution in a hydrocarbon.

* * * * *